US007833386B2

(12) United States Patent
Moser

(10) Patent No.: US 7,833,386 B2
(45) Date of Patent: Nov. 16, 2010

(54) METHOD FOR PRODUCING A FIBROUS WEB AND TWIN MESH FORMER FOR PERFORMING SAID METHOD

(75) Inventor: Johann Moser, Heidenheim (DE)

(73) Assignee: Voith Patent GmbH, Heidenheim (DE)

( * ) Notice: Subject to any disclaimer, the term of this patent is extended or adjusted under 35 U.S.C. 154(b) by 330 days.

(21) Appl. No.: 12/029,753

(22) Filed: Feb. 12, 2008

(65) Prior Publication Data

US 2008/0135197 A1 Jun. 12, 2008

Related U.S. Application Data

(63) Continuation of application No. PCT/EP2006/062511, filed on May 23, 2006.

(30) Foreign Application Priority Data

Aug. 12, 2005 (DE) ..... 10 2005 038 424

(51) Int. Cl.
*D21F 1/00* (2006.01)

(52) U.S. Cl. ..... 162/301; 162/300; 162/303; 162/352; 162/354

(58) Field of Classification Search ..... 162/300, 162/301, 303, 352, 203, 212, 216
See application file for complete search history.

(56) References Cited

U.S. PATENT DOCUMENTS

| | | | | |
|---|---|---|---|---|
| 5,045,153 | A | 9/1991 | Sollinger et al. | |
| 5,320,713 | A | 6/1994 | Bubik et al. | |
| 5,507,918 | A | 4/1996 | Polifke et al. | |
| 6,264,796 | B1 * | 7/2001 | Simmons | 162/216 |
| 2002/0043355 | A1 * | 4/2002 | Ruf et al. | 162/216 |
| 2002/0153113 | A1 * | 10/2002 | Ruf et al. | 162/216 |

FOREIGN PATENT DOCUMENTS

| | | |
|---|---|---|
| DE | 40 02 304 | 1/1990 |
| DE | 4005420 A1 | 8/1991 |
| EP | 1426488 A1 | 6/2004 |

* cited by examiner

*Primary Examiner*—Mark Halpern
(74) *Attorney, Agent, or Firm*—Taylor IP, PC

(57) ABSTRACT

This invention relates to a method for producing a fibrous web from at least one fibrous suspension in a twin mesh former with a twin mesh zone which has a wedge-shaped intake nip and is formed at least in some sections by two rotating endless meshes, of which the first mesh, which is passed over a preferably positionable inlet roller, is passed in the double mesh zone over several rails rigidly arranged a distance from each other on a preferably movable dewatering box, and of which the second mesh is passed in the twin mesh zone over several rails which are arranged opposite the rails of the preferably movable dewatering box, are supported by way of compliant elements and are pressed with a selectable force against the second mesh. The method further provides that in the region of an adjustable intersection point in which the first mesh intersects at a preferably adjustable intersection angle with the fibrous suspension lying on the second mesh, a locally acting dewatering pulse is introduced by way of the second mesh into the fibrous suspension. In addition, the invention relates to a twin mesh former of a machine for producing a fibrous web, in particular a paper web or paperboard web, from at least one fibrous suspension, and to a sheet forming system of a machine for producing a preferably multi-layer fibrous web, in particular a paper web or paperboard web, from at least one fibrous suspension.

25 Claims, 3 Drawing Sheets

METHOD FOR PRODUCING A FIBROUS WEB AND TWIN MESH FORMER FOR PERFORMING SAID METHOD

CROSS REFERENCE TO RELATED APPLICATIONS

This is a continuation of PCT application No. PCT/EP2006/062511, entitled "METHOD FOR PRODUCING A FIBROUS WEB AND TWIN-WIRE FORMER FOR CARRYING OUT SAID METHOD", filed May 23, 2006, which is incorporated herein by reference.

BACKGROUND OF THE INVENTION

1. Field of the Invention

This invention relates to a method for producing a fibrous web, in particular a paper web or paperboard web, from at least one fibrous suspension in a twin mesh former with a twin mesh zone which has a wedge-shaped intake nip and is formed at least in some sections by two rotating endless meshes, of which the first mesh, which is passed over a preferably positionable inlet roller, is passed in the double mesh zone over several rails rigidly arranged a distance from each other on a preferably movable dewatering box, and of which the second mesh is passed in the twin mesh zone over several rails which are arranged opposite the rails of the preferably movable dewatering box, are supported by means of compliant elements and are pressed with a selectable force against the second mesh.

In addition, the invention relates to a twin mesh former of a machine for producing a fibrous web, in particular a paper web or paperboard web, from at least one fibrous suspension, and to a sheet forming system of a machine for producing a preferably multi-layer fibrous web, in particular a paper web or paperboard web, from at least one fibrous suspension.

2. Description of the Related Art

A twin mesh former, known among those skilled in the art as a "hybrid former", is described in the German publication DE 40 02 304 A1.

It is characteristic of said type of former that the inlet, in particular the inlet conditions and the inlet geometries, of the fibrous suspension into the twin mesh zone in the region of the inlet gap are particularly important. Serious faults in the sheet forming, in particular on the upper side of the fibrous web to be formed, are often caused at this point. An example of such faults are bright spots.

Attempts have been made to reduce these faults by changing the so-called angle of intersection, but the effect of said measure was more than unsatisfactory under certain conditions such as excessively high turbulence on the mesh. The angle of intersection is defined here to mean the angle at which the first mesh intersects with the fibrous suspension lying on the second mesh at the point of intersection.

What is needed in the art is a method, a twin mesh former, and a sheet forming system such that faults are largely effectively prevented in particular during the initial sheet forming process in the region of the point of intersection even under difficult conditions.

SUMMARY OF THE INVENTION

The present invention provides a method in that, in the region of an adjustable point of intersection in which the first mesh intersects at a preferably adjustable angle with the fibrous suspension lying on the second mesh, at least one locally acting dewatering pulse is introduced by way of the second mesh into the fibrous suspension. The dewatering pulse is also adjustable preferably in its amplitude.

By introducing a so-called dewatering pulse by way of the second mesh into the fibrous suspension, the dewatering of the fibrous suspension in this region is notably improved, not least by a technologically promoted immersion of the first mesh into the fibrous suspension. Said improvement verifiably results in an effective elimination of the faults previously mentioned, in particular the bright spots. Furthermore, by promoting the immersion there is the resulting advantage of being able to achieve a higher operating speed with no sheet forming faults and on the whole higher levels of quality. Also, it is possible to operate the twin mesh former even with high turbulence of the fibrous suspension in the region of its pre-dewatering section and in particular prior to the immersion. Furthermore, the boundary air layer adjacent the first mesh and the fibrous suspension is removed by pressure through the first mesh and is unable therefore to penetrate into the fibrous suspension, which again leads in turn to a higher level of quality of said suspension.

In a first preferred embodiment the dewatering pulse is introduced directly underneath the point of intersection. It can thus be introduced selectively and therefore also very effectively.

Taking due account of practical aspects, the dewatering pulse is introduced preferably by at least one rail movable, in particular positionable, against the second mesh. The method of introducing the dewatering pulse is very effective on the one hand and economical to realize on the other.

So that the adjustability of the amplitude of the dewatering pulse is as good as possible, the respective rail movable, in particular positionable, against the second mesh is pressed preferably by way of a selectable force against the second mesh. In this case the respective rail movable, in particular positionable, against the second mesh is pressed with an adjustable, preferably controllable depth of immersion into the second mesh and hence into the fibrous suspension. Ideally the respective rail can also be individually positioned, meaning independently of the other rails. In this way the pressure pulse introduced by the rail into the fibrous suspension can be selectively influenced and even controlled. On the whole a maximum level of flexibility for the application thus exists in the face of changing operating parameters.

So that the generated dewatering pulse exerts an optimum effect, the respective rail movable, in particular positionable, against the second mesh is pressed preferably with a contact pressure in the range from 25 to 500 mbar, preferably from 50 to 300 mbar, against the second mesh. Said pressure ranges continually ensure the desired effect with regard to the generation of pulses for the dewatering.

Furthermore, in a preferred embodiment several, preferably up to five, in particular three rails movable, in particular positionable, against the second mesh are pressed by way of a preferably respectively selectable force against the second mesh, whereby preferably the middle rail is used for introducing the dewatering pulse. In this way, optimum operating conditions with regard to the introduction of the pressure pulses are assured for different angles of intersection and hence different points of intersections. Hence with three movable rails, the first rail effects a pre-stabilization of the second mesh, the middle rail effects the introduction of the defined and adjustable dewatering pulse at the point of intersection, and the third and last rail effects a stabilization of the mesh run to the first rail (skimmer rail) rigidly arranged on the dewatering box of the preferably movable dewatering box in the first mesh.

Furthermore, the dewatering pulse is introduced in favorable manner by at least one rail which is movable preferably in relation to a forming box, in particular can be positioned against a second mesh, and is arranged on the forming box which preferably can be positioned and preferably indirectly acts against the second mesh. In this case the respective rail movable, in particular positionable, against the second mesh is supported furthermore preferably by way of at least one compliant element on the forming box and pressed by way of a selectable force against the second mesh. In this way the pressure pulse introduced by the rail into the fibrous suspension can be selectively influenced and even controlled. In addition, the introduction of the defined and adjustable dewatering pulse by way of the second mesh into the fibrous suspension is enabled in practical manner. On the whole a maximum level of flexibility for the application thus exists in the face of changing operating parameters.

In connection with producing as many grades as possible with diverse production parameters in the twin mesh former, the inlet roller is preferably positioned such that the adjustable angle of intersection has an operating value in the range from 0.2 to 5°, preferably from 0.5 to 2°.

The rail, the forming box, the inlet roller or a selection of these components are positioned, for the purpose of introducing the desired dewatering pulse, in the region of, preferably directly underneath, the adjustable point of intersection preferably by way of at least one control circuit which includes at least one control unit loaded with a set-point value, one sensor for detecting the adjustable point of intersection, one sensor each for detecting the respective components, and several actuators for the components which can be loaded with a respective set-point variable.

A twin mesh former, in the region of the inlet nip of the twin mesh zone in which the first mesh intersects at a preferably adjustable angle of intersection at an adjustable point of intersection with the fibrous suspension lying on the second mesh, includes at least one rail movable, in particular positionable, against the second mesh which is arranged such that a locally acting dewatering pulse is introduced by way of the second mesh into the fibrous suspension in the region of the adjustable point of intersection of the first mesh with the fibrous suspension. The dewatering pulse is also adjustable preferably in its amplitude.

The dewatering of the fibrous suspension is notably improved in said region, which lies preferably directly underneath the point of intersection, by introducing the so-called dewatering pulse by way of the second mesh into the fibrous suspension. The previously listed advantages of the invention are obtained as the result.

Furthermore, the respective rail movable, in particular positionable, against the second mesh has preferably an adjustable, preferably controllable depth of immersion into the second mesh and hence into the fibrous suspension, whereby the respective rail can also be freely positionable, meaning positionable independently of the other rails. In this way the pressure pulse introduced by the rail into the fibrous suspension can be selectively influenced and even controlled. On the whole a maximum level of flexibility for the application thus exists in the face of changing operating parameters.

So that the generated dewatering pulse exerts an optimum effect, the respective rail movable, in particular positionable, against the second mesh has in a preferred embodiment a contact pressure in the range from 25 to 500 mbar, preferably from 50 to 300 mbar. Said pressure ranges continually ensure the desired effect with regard to the generation of pulses for the dewatering.

Furthermore, two adjacent rails movable, in particular positionable, against the second mesh are spaced apart ideally by a distance in the range from 50 to 300 mm, preferably from 100 to 250 mm, whereby the distances between two adjacent rails movable, in particular positionable, against the second mesh are identical, approximately identical or different. The quoted distance ranges essentially guarantee a guidance of the second mesh which is optimal in geometrical and process engineering terms.

In another favorable embodiment the respective rail movable, in particular positionable, against the second mesh has an effective width in the range from 3 to 50 mm, preferably from 10 to 30 mm. In this case the effective widths touched by the second rail of several rails movable, in particular positionable, against the second mesh can be identical, approximately identical or different. Said effective width ranges guarantee among other things a reliable guidance of the second mesh by way of sufficiently large guide faces.

The respective rail movable, in particular positionable, against the second mesh has preferably a foil angle on the second mesh in the range from 0 to 3°, preferably from 0.5 to 2°, whereby the foil angle on the second mesh of several rails movable, in particular positionable, against the second mesh can be identical, approximately identical or different. By this way an influence is exerted in particular in efficient manner on the turbulence and hence on the formation of the fibrous web to be produced.

In a first preferred embodiment of the inventive twin mesh former, several, preferably up to five, in particular three mutually independent rails movable, in particular positionable, against the second mesh can be pressed by way of a preferably respectively selectable force against the second mesh, whereby preferably the middle rail is used for introducing the dewatering pulse. In this way optimum operating conditions with regard to the introduction of the pressure pulses are assured for different angles of intersection and hence different points of intersections. Hence with three movable rails, as already explained, the first rail effects a pre-stabilization of the second mesh, the middle rail effects the introduction of the defined and adjustable dewatering pulse at the point of intersection, and the third and last rail effects a stabilization of the mesh run to the first rail (skimmer rail) rigidly arranged on the dewatering box of the preferably movable dewatering box in the first mesh.

In the interest of stable operating conditions, the at least one rail which is movable preferably in relation to a forming box, in particular positionable against the second mesh, is arranged on the forming box which preferably can be positioned and preferably indirectly acts against the second mesh. In this case the forming box lends the system a certain measure of stability and reproducibility.

It is an advantage in this case for the respective rail movable, in particular positionable, against the second mesh to be supported by way of at least one compliant element on the forming box and pressed by way of a selectable force against the second mesh.

For essential changes to the process, in particular a change of paper grade with all related changes to production parameters such as gsm substance and the like, provision is made for the inlet roller guiding the first mesh to be freely positionable for the purpose of positioning the adjustable point of intersection and hence setting the adjustable angle of intersection. It is thus possible to respond quickly, cost-efficiently and precisely to changes of layer height and turbulence upstream from the twin mesh zone and in the region of the inlet nip.

So that as many grades as possible can be produced with diverse production parameters in the twin mesh former, the inlet roller is positionably arranged such that the adjustable angle of intersection has an operating value in the range from 0.2 to 5°, preferably from 0.5 to 2°.

Also, the first rail of the preferably movable dewatering box is preferably a part of a skimmer apparatus having a preferably adjustable skimmer channel. Said skimmer apparatus effects among other things a fast, reliable and efficient discharge of the mesh water which has emerged from the top of the first mesh.

In a preferred practical embodiment provision is made in addition for the positioning of the rail, the forming box, the inlet roller and/or a selection of these components to be effected by at least one control circuit which includes at least one control unit loaded with a setpoint value, one sensor for detecting the adjustable point of intersection, and several actuators which can be loaded with a respective set-point variable. This provides an always optimum setting of the twin mesh former even during operation of the machine for producing the fibrous web. The at least one actuator is preferably an operating mechanism for moving the rail, the compliant element for the rail, an operating mechanism for the forming box and/or an operating mechanism for the inlet roller.

The inventive sheet forming system of a machine for producing a preferably multi-layer fibrous web, in particular a paper web or paperboard web, from at least one fibrous suspension, with at least one headbox, having a headbox nozzle, and with at least one twin mesh former downstream from the headbox, is characterized in that at least one disk is arranged in the headbox nozzle in order to influence and improve the stream quality and in that the twin mesh former is constructed according to the invention.

Both the sheet forming system and the method according to the invention have the previously mentioned inventive advantages.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein.

Corresponding reference characters indicate corresponding parts throughout the several views. The exemplifications set out herein illustrate embodiments of the invention, and such exemplifications are not to be construed as limiting the scope of the invention in any manner.

DETAILED DESCRIPTION OF THE INVENTION

Figure 1:
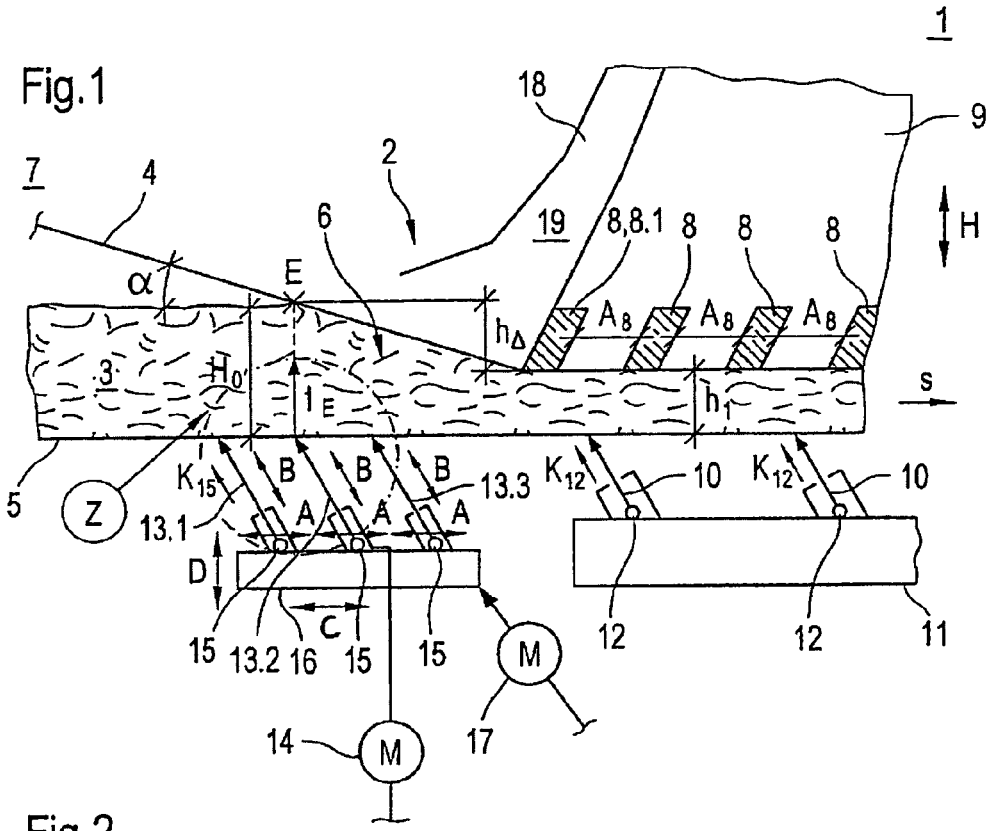
FIG. 1 shows, in a schematic side view in section, a start region of a twin mesh zone of an inventive twin mesh former.

Referring now to the drawings, and more particularly to FIG. 1, there is shown in a schematic side view in section, a start region of a twin mesh zone 2 of a twin mesh former 1.

The twin mesh former 1 is part of a machine (not shown further) for producing a fibrous web, in particular a paper web or paperboard web, from at least one fibrous suspension 3.

It includes two rotating endless meshes: a first mesh 4, which is also referred to as the upper mesh, and a second mesh 5, which is also referred to as the lower mesh or support mesh. The meshes 4, 5 form at least in some sections the twin mesh zone 2, which has a wedge-shaped inlet nip 6 for the fibrous suspension 3. The introduction (not illustrated) of the fibrous suspension 3 is performed according to the representation in FIG. 4 by way of at least one known headbox 30 whose headbox nozzle 31 can be equipped in addition with at least one disk 32 in order to influence and improve the stream quality.

In the twin mesh zone 2 the first mesh 4, which is guided over an inlet roller 7 (not illustrated), runs over several rails 8, which are rigidly arranged a distance $A_8$ from each other on a dewatering box 9. In this case the rails 8 can have different dimensions, the distances $A_8$ can adopt at least in part different values, and the dewatering box 9 can be constructed in particular as, what is known to those skilled in the art, an upper mesh suction box. In addition, the rails 8 can be arranged—looking transverse to the mesh running direction S (arrow)—along a straight, curved or straight and curved line, whereby in the case of a curve the radius of curvature lies preferably in the range from 1 to 15 m, preferably from 2 to 10 m. Furthermore, the dewatering box 9 is movably mounted in order to set the penetration depth $h_1$ via the height direction H (double arrow), as is disclosed for example in the German publication DE 40 05 420 A1. With a possible movement of the dewatering box 9, the bars 8 rigidly arranged on it are also moved along identical vectorial lines, whereby the movement can have a linear and/or rotary movement component. Furthermore, a combined movement, preferably a movement in the height direction combined with a movement in the mesh running direction S (arrow), is possible.

In addition, the second mesh 5 runs in the twin mesh zone 2 over several movable rails 10 (implied by arrows), which are arranged on a device 11 opposite the rails 8 of the dewatering box 9. The device 11 can be for example a carrier structure or the like. The rails 10 are movably supported by way of compliant elements 12 in relation to the device 11 and can thus be flexibly pressed with a selectable force $K_{12}$ (arrow) against the second mesh 5 and therefore can also be positioned accordingly. The compliant elements 12 can be in known manner springs, pneumatic pressure cushions or the like.

In the region of the inlet nip 6 of the twin mesh zone 2, in which the first mesh 4 intersects at an adjustable angle of intersection alpha at an adjustable point of intersection E with the fibrous suspension 3 lying on the second mesh 5 with a fibrous suspension height $H_0$, at least one rail movable, in particular positionable, against the second mesh 5 is arranged such that a locally acting dewatering pulse $I_E$ with a preferably adjustable amplitude is introduced by way of the second mesh 5 into the fibrous suspension 3 in the region preferably directly underneath the adjustable point of intersection E of the first mesh 4 with the fibrous suspension 3. The region of introduction of the preferably adjustable dewatering pulse $I_E$ includes in this case by definition the intersection point E+/−35 mm, meaning 35 mm in the mesh running direction S (arrow) and 35 mm in the opposite direction to the mesh running direction S (arrow). In the represented embodiment there are altogether three rails 13.1, 13.2 and 13.3, whereby the middle rail 13.2 is used for introducing the dewatering pulse $I_E$ into the fibrous suspension 3.

Hence according to the inventive method, in the region of the adjustable intersection point E in which the first mesh 4 intersects at a preferably adjustable intersection angle alpha with the fibrous suspension 3 lying on the second mesh 5, a locally acting dewatering pulse $I_E$ is introduced by way of the second mesh 5 into the fibrous suspension 3.

The respective positionability of the rails 13.1, 13.2 and 13.3 is represented by the corresponding double-headed movement arrows A and B. The double-headed movement arrow A represents for example the possible and also preferred displacement of the corresponding rail 13.1, 13.2, and 13.3 in the mesh running direction S (arrow), whereas the double-headed movement arrow B represents the possible positioning of the corresponding rail 13.1, 13.2 and 13.3 relative to the second mesh 5 (cf. FIG. 2). The displacement of the corresponding rail 13.1, 13.2 and 13.3 in the mesh running direction S (arrow) takes place for example by way of an operating mechanism 14 (implied only schematically) for the rail 13.2, whereas the positioning of the corresponding rail 13.1, 13.2 and 13.3 in relation to the second mesh 5 takes place by way of a compliant element 15 (again implied only schematically). The respective operating mechanism 14 can include for example an electric motor, a pneumatic and/or hydraulic adjusting unit. The compliant elements 15 can again be in known manner springs, pneumatic pressure pads or the like. The respective rail 13.1, 13.2 and 13.3 can thus be pressed by way of a preferably selectable force $K_{15}$ against the second mesh 5.

In addition, the three rails 13.1, 13.2 and 13.3 are arranged on a forming box 16, which can be positioned and acts indirectly against the second mesh 5, whereby the rails 13.1, 13.2 and 13.3 are movable in this embodiment again in relation to the forming box 16. The positioning of the forming box 16 can take place in principle in all directions. For example it can take place in the mesh running direction (double-headed movement arrow C) or toward the second mesh 5 (double-headed movement arrow D). Said positioning takes place preferably by way of an operating mechanism 17 (schematically represented), which includes for example an electric motor, a pneumatic and/or hydraulic adjusting unit. In principle the forming box 16 can also be arranged in a fixed position, whereby in this case only the rails 13.1, 13.2, 13.3 are then movable, in particular positionable, in relation to it.

The inlet roller 7 (not illustrated) guiding the first mesh 4 is freely positionable for the purpose of positioning the adjustable intersection point E and hence setting the adjustable intersection angle alpha. The positioning of the inlet roller 7 takes place preferably by way of an operating mechanism which can include for example an electric motor, a pneumatic and/or hydraulic adjusting unit. The inlet roller 7 is positionably arranged such that the adjustable intersection angle alpha has an operating value in the range from 0.2 to 5°, preferably from 0.5 to 2°.

In addition, the first rail 8.1 of the dewatering box 9 is a part of a skimmer apparatus 18 having a preferably adjustable skimmer channel 19. The possible setting of the skimmer channel 19 can be performed for example by changing the channel cross-section, whereby the change of channel cross-section can be performed in known manner by inserting a filler piece with a changed contour, or by an effective change of volume of a pneumatic insert or the like.

The twin mesh zone 2 has in the region of the dewatering box 9 a penetration depth $h_1$ so that the fibrous suspension height is reduced by the value $h_\Delta$ over the course of the inlet nip 6. The reduction in the effective fibrous suspension height is effected essentially by the position of the first rail 8.1 of the dewatering box 9 in the height direction H (double arrow).

Figure 2:
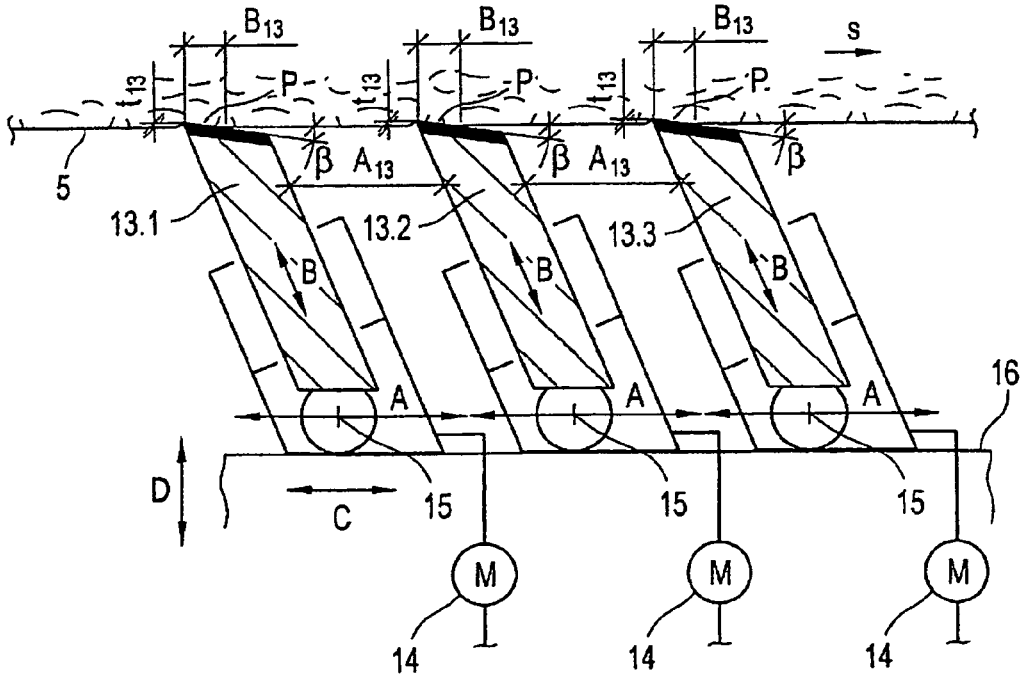
FIG. 2 shows, in a schematic view, detail Z from FIG. 1.

FIG. 2 shows, in a schematic view, detail Z from FIG. 1.

It is evident that the rails 13.1, 13.2 and 13.3 are positionable (double-headed movement arrows A and B). The respective double-headed movement arrow A represents for example the possible and also preferred displacement of the corresponding rail 13.1, 13.2, and 13.3 in the mesh running direction S (arrow), whereby the displacement of the corresponding rail 13.1, 13.2 and 13.3 in the mesh running direction S (arrow) is effected for example by an operating mechanism 14 (implied only schematically). By contrast, the respective double-headed movement arrow B represents the possible positioning of the corresponding rail 13.1, 13.2, and 13.3 in relation to the second mesh 2, whereby the positioning of the corresponding rail 13.1, 13.2 and 13.3 in relation to the second mesh 2 is effected by a compliant element 15 (again implied only schematically). The respective operating mechanism 14 can include for example an electric motor, a pneumatic and/or hydraulic adjusting unit. The compliant elements 15 can again be in known manner springs, pneumatic pressure pads or the like.

In addition it is evident that two adjacent rails 13.1, 13.2 und 13.2, 13.3 movable, in particular positionable, against the second mesh 5 of the positionable forming box 16 (double-head movement arrows C, D) have a distance $A_{13}$ from each other in the range from 50 to 300 mm, preferably from 100 to 250 mm. In this case the distances $A_{13}$ can of course be identical, approximately identical or different.

In addition the rail 13.1, 13.2, 13.3 movable, in particular positionable, against the second mesh 5 of the positionable forming box 16 (double-headed movement arrows C, D) has an effective width $B_{13}$ in the range from 3 to 50 mm, preferably from 10 to 30 mm. In this case the effective widths $B_{13}$ can of course be identical, approximately identical or different.

The respective rail 13.1, 13.2, 13.3 movable, in particular positionable, against the second mesh 5 of the positionable forming box 16 (double-headed movement arrows C, D) also has a foil angle beta on the second mesh 5 in the range from 0 to 3°, preferably from 0.5 to 2°. In this case the foil angle beta on the second mesh 5 can of course be identical, approximately identical or different.

In addition each rail 13.1, 13.2, 13.3 movable, in particular positionable, against the second mesh 5 of the positionable forming box 16 (double-headed movement arrows C, D) has an adjustable, preferably controllable immersion depth $t_{13}$ into the second mesh 5 and hence into the fibrous suspension 3. In this case the respective contact pressure p adopts a value in the range from 25 to 500 mbar, preferably from 50 to 300 mbar.

Figure 3:
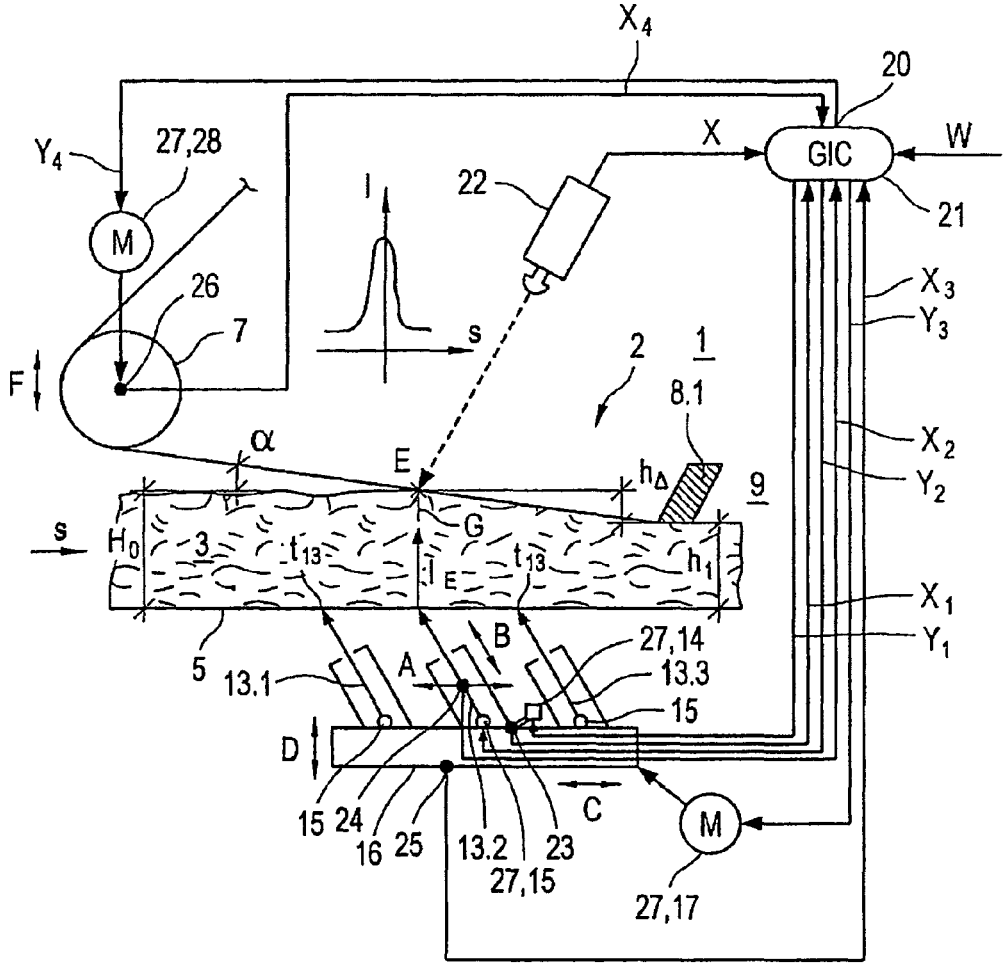
FIG. 3 shows, in a schematic side view in section, the extended start region of the twin mesh zone of the inventive twin mesh former from FIG. 1 including the control concept.

FIG. 3 shows, in a schematic side view in section, the extended start region of the twin mesh zone 2 of the inventive twin mesh former 1 from FIG. 1 including control concept.

For the purpose of introducing the desired dewatering pulse $I_E$ (arrow) in the region of, preferably directly underneath, the intersection point E, the control concept provides for the use of a control circuit 20 which includes a control unit (GIC) loaded with a set-point value W (arrow) and a sensor 22 for detecting the intersection point E (controlled variable X; arrow) and respectively one sensor 24, 25, 26 for detecting the position (controlled variables $X_1$, $X_2$, $X_3$, $X_4$; arrow) of the respective component 13.2, 16, 7, and several actuators 27 for the components which can be loaded with a respective set-point variable $Y_1$, $Y_2$, $Y_3$, $Y_4$ (arrow). The sensors 22, 23, 24 and 26 are preferably commercially available position sensors.

On the control side it is thus possible, with regard to the periphery of the intersection point E, to realize the following scenarios either each on its own or at least partly in combination with each other:

Individual control of the position of the rails 13.1, 13.2 (double-headed movement arrow A), 13.3 in the mesh running direction S (arrow);

Individual control of the position of the rails 13.1, 13.2 (double-headed movement arrow B), 13.3 toward the second mesh 5;

Control of the position of the forming box 16, whereby the compliant elements 15 of all the rails 13.1, 13.2, 13.3 and hence the rails 13.1, 13.2, 13.3 themselves are moved (double-headed movement arrows C, D); and Control of the preferably vertical position of the inlet roller 7 (double-headed movement arrow F).

In the example in question, the actuators 27 loaded by the control unit 21 are the respective operating mechanism 14 for the rails 13.1, 13.2 and 13.2, the respective compliant element 15 for the rails 13.1, 13.2, 13.3, the operating mechanism 17 for the forming box 16 and the operating mechanism 28 for the inlet roller 7, whereby the actuators 27 can be loaded singly or together. On the control side, the control circuit 20 can be connected in turn to a higher-level process control system (PLS) which is known to those skilled in the art. Hence the control concept is orientated primarily to detecting and optimizing the position of introduction of the dewatering pulse $I_E$ (arrow). In addition, the rails 13.1, 13.3 can also be in known manner a part of the control circuit 20.

The individual loading of the actuator 27 respecting operating mechanism 14 for the rail 13.2 effects a positioning (double-headed movement arrow A) of the rail 13.2 so that the middle rail 13.2 makes contact in the region of, preferably directly underneath, the intersection point E and takes effect by introducing a defined and adjustable dewatering pulse $I_E$ by way of the second mesh 5 into the fibrous suspension 3. The term "direct" defines in this case the position of the middle rail 13.2 in relation to the intersection point E, whereby in an optimum embodiment both criteria lie on a straight line G which is orientated preferably perpendicular to the running direction of the second mesh 5. The intersection point E is defined by the position of the inlet roller 7, the size of the inlet angle alpha and the position of the first rail 8.1 of the dewatering box 9. The desired defined and adjustable dewatering pulse $I_E$ is schematically represented in a travel/pulse diagram.

The individual loading of the actuator 27 respecting compliant element 15 for the movable rail 13.2 effects a positioning (double-headed movement arrow B) of the movable rail 13.2 again so that the middle rail 13.2 makes contact directly underneath the intersection point E and takes effect by introducing a defined and adjustable dewatering pulse $I_E$ by way of the second mesh 5 into the fibrous suspension 3.

The loading of the actuator 27 "operating mechanism 17 for the forming box 16" effects a positioning (double-headed movement arrows C, D) of the forming box 16 again so that the middle rail 13.2 makes contact in the region of, preferably directly underneath, the intersection point E and takes effect by introducing a defined and adjustable dewatering pulse $I_E$ by way of the second mesh 5 into the fibrous suspension 3.

And finally the loading of the actuator 27 respecting operating mechanism 28 for the inlet roller 7 effects a preferably vertical positioning (double-headed arrow F) of the inlet roller 7 and hence a change of the adjustable intersection angle alpha of the first mesh into the fibrous suspension 3 with a further change of enwrapment of the first rail 8.1 of the dewatering box 9. Generally, the inlet roller 7 is positioned such that the intersection angle alpha has an operating value in the range from 0.2 to 5°, preferably from 0.5 to 2°.

The twin mesh zone 2 has in the region of the dewatering box 9 a penetration depth $h_1$ so that the fibrous suspension height is reduced by the value $h_\Delta$ over the course of the inlet nip 6.

The control concept provides for the actuators to be loadable together, individually, in pairs or/and in groups. The objective of all possible loadings is always for the middle rail 13.2 to make contact in the region of, preferably directly underneath, the intersection point E and take effect by introducing a defined and adjustable dewatering pulse $I_E$ by way of the second mesh 5 into the fibrous suspension 3.

Figure 4:
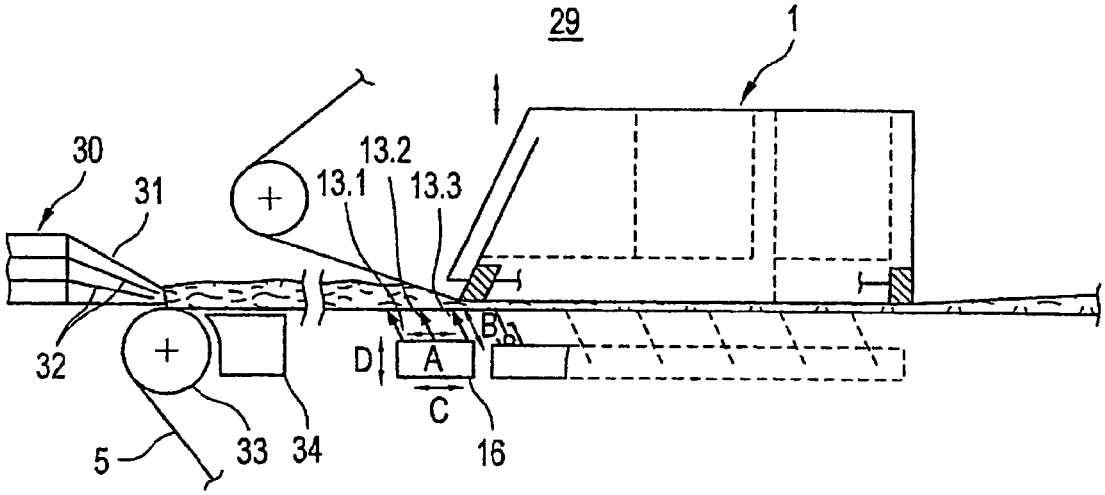
FIG. 4 shows, in a schematic view in section, a sheet forming system with a headbox and an inventive twin mesh former.

FIG. 4 shows, in a schematic view in section, a sheet forming system 29 which includes a headbox 30 and a twin mesh former 1.

The headbox 30, which is known to those skilled in the art and equipped with a known dilution water control system, includes a headbox nozzle 31 in which at least one disk 32 is arranged in order to influence and improve the stream quality.

The twin mesh former 1 on the other hand has at the start end a breastroll 33 over which the second mesh 5 is passed. The second mesh 5 then picks up on the top side the fibrous suspension 3 dispensed from the headbox 30. Arranged on the bottom side in this region of the second mesh 5 is a mesh table 34 whose preferably ceramic covering is equipped preferably with openings, in particular slits or holes. An improvement of the stream impact conditions is thus achieved.

The twin mesh former 1 includes in addition a positionable forming box 16 (double-headed movement arrows C, D), which in the illustrated embodiment includes three rails 13.1, 13.2, 13.3 movable, in particular positionable, against the second mesh 5 (double-headed movement arrows A, B). In another embodiment the twin mesh former corresponds to the representations according to FIGS. 1 to 3.

The inventive twin mesh former 1 and the inventive sheet forming system 29 are both excellently suited for performing the inventive method for producing a fibrous web, in particular a paper web or paperboard web, from at least one fibrous suspension.

In summary it is to be recorded that as the result of the invention there is created a method, a twin mesh former and a sheet forming system of the types initially referred to which largely effectively prevent faults in particular during the initial sheet forming process in the region of the point of intersection even under difficult conditions.

While this invention has been described with respect to at least one embodiment, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

List of reference numerals

| | |
|---|---|
| 1 | Twin mesh former |
| 2 | Twin mesh zone |
| 3 | Fibrous suspension |
| 4 | First mesh |
| 5 | Second mesh |
| 6 | Inlet nip |
| 7 | Inlet roller |
| 8 | Rail |
| 8.1 | First rail |
| 9 | Dewatering box |

-continued

| List of reference numerals | |
|---|---|
| 10 | Rail |
| 11 | Device |
| 12 | Compliant element |
| 13.1 | Rail |
| 13.2 | Rail |
| 13.3 | Rail |
| 14 | Operating mechanism |
| 15 | Compliant element |
| 16 | Forming box |
| 17 | Operating mechanism |
| 18 | Skimmer apparatus |
| 19 | Skimmer channel |
| 20 | Control circuit |
| 21 | Control unit (GIC) |
| 22 | Sensor |
| 23 | Sensor |
| 24 | Sensor |
| 25 | Sensor |
| 26 | Sensor |
| 27 | Actuator |
| 28 | Operating mechanism |
| 29 | Sheet forming system |
| 30 | Headbox |
| 31 | Headbox nozzle |
| 32 | Disk |
| 33 | Breast roll |
| 34 | Mesh table |
| A | Double-headed movement arrow |
| $A_8$ | Distance |
| $A_{13}$ | Distance |
| B | Double-headed movement arrow |
| $B_{13}$ | Effective width |
| C | Double-headed movement arrow |
| D | Double-headed movement arrow |
| E | Intersection point |
| F | Double-headed movement arrow |
| G | Straight line |
| H | Height direction (double-headed arrow) |
| $h_A$ | Fibrous suspension height difference |
| $H_0$ | Fibrous suspension height |
| $h_1$ | Penetration depth |
| $I_E$ | Dewatering pulse (arrow) |
| $K_{12}$ | Force (arrow) |
| $K_{15}$ | Force (arrow) |
| L | Machine running direction |
| p | Contact pressure |
| S | Mesh running direction (arrow) |
| $t_{13}$ | Immersion depth |
| W | Set-point value (arrow) |
| $X, X_1, X_2, X_3, X_4$ | Controlled variable (arrow) |
| $Y_1, Y_2, Y_3, Y_4$ | Set-point variable (arrow) |
| Z | Detail view |
| alpha | Intersection angle |
| beta | Foil angle |

What is claimed is:

1. A twin mesh former of a machine for producing a web of fibrous material from at least one fibrous suspension, said twin mesh former comprising:

two rotating endless meshes including a first mesh and a second mesh, said two rotating endless meshes at least in part together forming a twin mesh zone including a wedge-shaped inlet nip;

a positionable inlet roller;

a movable dewatering box;

a first plurality of rails, in said twin mesh zone said first mesh, which is passed over said positionable inlet roller, running over said first plurality of rails, said first plurality of rails being rigidly arranged a distance from each other on said movable dewatering box;

a first plurality of compliant elements;

a second plurality of rails which is arranged opposite said first plurality of rails of said movable dewatering box, supported by said first plurality of compliant elements, and configured for being pressed with a selectable first force against said second mesh, said second mesh running in said twin mesh zone over said second plurality of rails;

at least one additional rail which is positionable against said second mesh, the twin mesh former having an inlet nip region and an adjustable intersection point region, said inlet nip region being associated with said inlet nip of said twin mesh zone, said adjustable intersection point region being associated with an adjustable intersection point, in said inlet nip region, in which said first mesh intersects at an adjustable intersection angle at said adjustable intersection point with the fibrous suspension lying on said second mesh, said at least one additional rail being positionable against said second mesh and being arranged such that a locally acting dewatering pulse is introduced by said second mesh into the fibrous suspension in said adjustable intersection point region; and a forming box, said at least one additional rail being movable relative to said forming box, being positionable against said second mesh, and being arranged on said forming box, which is configured for being positioned and which indirectly acts against said second mesh.

2. The twin mesh former according to claim 1, wherein said at least one additional rail has an adjustable immersion depth into said second mesh and thereby into the fibrous suspension.

3. The twin mesh former according to claim 1, wherein said at least one additional rail has a controllable immersion depth into said second mesh and thereby into the fibrous suspension.

4. The twin mesh former according to claim 1, wherein said at least one additional rail has a contact pressure in a range from 25 to 500 mbar.

5. The twin mesh former according to claim 1, wherein said at least one additional rail has a contact pressure in a range from 50 to 300 mbar.

6. The twin mesh former according to claim 1, wherein said at least one additional rail is freely positionable.

7. The twin mesh former according to claim 1, wherein said at least one additional rail includes a third plurality of rails including a first rail, a second rail, and a third rail, said first and second rails being adjacent to one another, said second and third rails being adjacent to one another, each of said first, second, and third rails being positionable against said second mesh, said first and second rails having a first distance from each other in a range from 50 to 300 mm, said second and third rails having a second distance from each other in a range from 50 to 300 mm.

8. The twin mesh former according to claim 7, wherein said first and second distances are one of identical, approximately identical, and different.

9. The twin mesh former according to claim 1, wherein said at least one additional rail includes a third plurality of rails including a first rail, a second rail, and a third rail, said first and second rails being adjacent to one another, said second and third rails being adjacent to one another, each of said first, second, and third rails being positionable against said second mesh, said first and second rails having a first distance from each other in a range from 100 to 250mm , said second and third rails having a second distance from each other in a range from 100 to 250 mm.

10. The twin mesh former according to claim 1, wherein said at least one additional rail has an effective width in a range from 3 to 50 mm.

11. The twin mesh former according to claim 10, wherein said at least one additional rail includes a third plurality of rails which are positionable against said second mesh, an effective width of said third plurality of rails being one of identical, approximately identical, and different.

12. The twin mesh former according to claim 1, wherein said at least one additional rail has an effective width in a range from 10 to 30 mm.

13. The twin mesh former according to claim 1, wherein said at least one additional rail has a foil angle on said second mesh in a range from 0 to 3°.

14. The twin mesh former according to claim 13, wherein said at least one additional rail includes a third plurality of rails which are positionable against said second mesh, each of said third plurality of rails having said foil angle which is one of identical, approximately identical, and different relative to one another.

15. The twin mesh former according to claim 1, wherein said at least one additional rail has a foil angle on said second mesh in a range from 0.5 to 2°.

16. The twin mesh former according to claim 1, wherein said at least one additional rail includes a third plurality of rails which are positionable against said second mesh, said third plurality of rails including a middle rail configured for introducing said dewatering pulse, up to three of said third plurality of rails being configured for being pressed by a respectively selectable second force against said second mesh.

17. The twin mesh former according to claim 1, wherein said at least one additional rail includes a third plurality of rails which are positionable against said second mesh, said third plurality of rails including a middle rail configured for introducing said dewatering pulse, up to five of said third plurality of rails being configured for being pressed by a respectively selectable second force against said second mesh.

18. The twin mesh former according to claim 1, further comprising at least one additional compliant element, said at least one additional rail being supported by said at least one additional compliant element on said forming box and being configured for being pressed by a selectable second force against said second mesh.

19. The twin mesh former according to claim 18, further comprising a control circuit configured for positioning at least one of said at least one additional rail, said forming box, and said inlet roller, said control circuit including a) a control unit loaded with a set-point value, b) a first sensor for detecting said adjustable intersection point, c) at least one second sensor for detecting respectively a position of said at least one of said at least one additional rail, said forming box, and said inlet roller, and d) a plurality of actuators respectively for said at least one of said at least one additional rail, said forming box, and said inlet roller, said plurality of actuators being configured for being loaded respectively with a plurality of set-point variables.

20. The twin mesh former according to claim 19, wherein said at least one additional rail includes a third plurality of rails, wherein said plurality of actuators includes at least one of a first actuator which is an operating mechanism for moving said third plurality of rails, a second actuator which is an operating mechanism for moving said at least one additional compliant element, a third actuator which is an operating mechanism for said forming box, and a fourth actuator which is an operating mechanism for said inlet roller.

21. The twin mesh former according to claim 1, wherein said positionable inlet roller guides said first mesh and is freely positionable for positioning said adjustable intersection point and thereby setting said adjustable intersection angle.

22. The twin mesh former according to claim 21, wherein said positionable inlet roller is positioned such that said adjustable intersection angle has an operating value in a range from 0.2 to 5°.

23. The twin mesh former according to claim 21, wherein said positionable inlet roller is positioned such that said adjustable intersection angle has an operating value in a range from 0.5 to 2°.

24. The twin mesh former according to claim 1, further comprising a skimmer apparatus having a skimmer channel, said first plurality of rails including a first rail of said movable dewatering box, said first rail being a part of said skimmer apparatus.

25. A sheet forming system of a machine for producing a web of fibrous material from at least one fibrous suspension, said system comprising:

at least one headbox having a headbox nozzle;

a disk arranged in said headbox nozzle and configured for influencing and improving a stream quality; and at least one twin mesh former downstream from said headbox, said at least one twin mesh former including:

two rotating endless meshes including a first mesh and a second mesh, said two rotating endless meshes at least in part together forming a twin mesh zone including a wedge- shaped inlet nip;

a positionable inlet roller;

a movable dewatering box;

a first plurality of rails, in said twin mesh zone said first mesh, which is passed over said positionable inlet roller, running over said first plurality of rails, said first plurality of rails being rigidly arranged a distance from each other on said movable dewatering box;

a first plurality of compliant elements;

a second plurality of rails which is arranged opposite said first plurality of rails of said movable dewatering box, supported by said first plurality of compliant elements, and configured for being pressed with a selectable force against said second mesh, said second mesh running in said twin mesh zone over said second plurality of rails;

at least one additional rail which is positionable against said second mesh, the twin mesh former having an inlet nip region and an adjustable intersection point region, said inlet nip region being associated with said inlet nip of said twin mesh zone, said adjustable intersection point region being associated with an adjustable intersection point, in said inlet nip region, in which said first mesh intersects at an adjustable intersection angle at said adjustable intersection point with the fibrous suspension lying on said second mesh, said at least one additional rail being positionable against said second mesh and being arranged such that a locally acting dewatering pulse is introduced by said second mesh into the fibrous suspension in said adjustable intersection point region; and a forming box, said at least one additional rail being movable relative to said forming box, being positionable against said second mesh, and being arranged on said forming box, which is configured for being positioned and which indirectly acts against said second mesh.

* * * * *